US005405576A

United States Patent [19]

Kusui et al.

[11] Patent Number: 5,405,576

[45] Date of Patent: Apr. 11, 1995

[54] HYPEREUTECTIC ALUMINUM-SILICON ALLOYS PRODUCED BY POWDER METALLURGY TECHNIQUES

[75] Inventors: Jun Kusui, Yokaichi; Akiei Tanaka, Omi-Hachiman; Kohei Kubo, Gamo; Takashi Watsuji, Omi-Hachiman; Takamasa Yokote, Nara, all of Japan

[73] Assignees: Toyo Aluminum Kabushiki Kaisha; Sumitomo Electric Industries, Ltd., both of Osaka, Japan

[21] Appl. No.: 914,105

[22] Filed: Jul. 16, 1992

[30] Foreign Application Priority Data

Jul. 22, 1991 [JP] Japan ..... 3-181288

[51] Int. Cl.[6] ..... C22C 21/02

[52] U.S. Cl. ..... 420/534; 148/438; 148/439; 420/537; 420/546; 420/548; 420/549

[58] Field of Search ..... 420/534, 548, 537, 546, 420/549; 148/437, 438, 439, 440; 75/351, 684

[56] References Cited

U.S. PATENT DOCUMENTS

| | | | |
|---|---|---|---|
| 3,953,202 | 4/1976 | Rasmussen | 420/548 |
| 4,681,736 | 7/1987 | Kersker et al. | 420/537 |
| 5,234,514 | 8/1993 | Donahue et al. | 420/534 |

FOREIGN PATENT DOCUMENTS

| | | |
|---|---|---|
| 45-1538 | 1/1970 | Japan . |
| 59-37339 | 9/1984 | Japan . |
| 63-266004 | 11/1988 | Japan . |
| 1-147038 | 6/1989 | Japan . |
| 2-213401 | 8/1990 | Japan . |
| WO92/07676 | 10/1991 | WIPO . |

OTHER PUBLICATIONS

Chemical Abstracts, vol. 107, No. 20, Nov. 1987 Terajima et al "Sliding Parts from aluminum powder" p. 355 Abstract No. 181 610v.

*Primary Examiner*—Scott Kastler
*Assistant Examiner*—Robert R. Koehler
*Attorney, Agent, or Firm*—Nixon & Vanderhye

[57] ABSTRACT

A hypereutectic aluminum-silicon alloy produced by a powder metallurgy technique disclosed herein comprises 12 to 50% by weight of silicon, 1.0 to 5.0% by weight of copper and 0.01 to 0.05% by weight of phosphorus, the content of Ca as an impurity being controlled to be 0.03% by weight or less. The hyereutectic aluminum-silicon alloy of the present invention is excellent in machinability and mechanical strength.

5 Claims, No Drawings

HYPEREUTECTIC ALUMINUM-SILICON ALLOYS PRODUCED BY POWDER METALLURGY TECHNIQUES

FIELD OF THE INVENTION

The present invention relates to hypereutectic aluminum-silicon alloys produced by powder metallurgy techniques. More specifically, it relates to the hypereutectic aluminum-silicon alloys with refined primary silicon particles, thereby their machinabilities and their mechanical properties can be improved.

BACKGROUND OF THE INVENTION

The hypereutectic aluminum-silicon alloys have been produced by casting methods. The hypereutectic aluminum-silicon casting alloys have been expected to be applied in various fields due to low coefficient of thermal expansion, high modulus and good wear resistance, but in practice they are not applied. The main reason is that they contain coarse primary silicon particles which give a product having poor machinabilities and poor mechanical properties. Thus, for improving the machinability and the mechanical strength, the refinement of the primary silicon particles in the hypereutectic aluminum-silicon casting alloy is effected by adding a modifier for refining the primary silicon particles, particularly such a modifier containing phosphorus. Unfortunately, the addition of the modifier for refining the primary silicon particles cannot give the well-refined primary silicon particles. Especially when the hypereutectic aluminum-silicon casting alloy contains 20% by weight or more of silicon, the coarse primary silicon particles are found.

Recently, it has been proposed to produce the hypereutectic aluminum-silicon alloy by a rapid solidification method. According to this method, the hypereutectic aluminum-silicon alloy with refined primary silicon particles can be obtained, even if it contains 20% by weight or more of silicon. In this case, the improvement of the machinability is satisfactory to a certain extent, but the improvement of the mechanical properties is limited. The addition of the modifier for refining the primary silicon particles could not give the satisfactory improvement of the mechanical properties.

An object of the present invention is to provide the hypereutectic aluminum-silicon alloy produced by the powder metallurgy technique, which contains the well-refined primary silicon particles.

Another object of the present invention is to provide the hypereutectic aluminum-silicon alloy produced by the powder metallurgy technique, which is excellent in machinability and mechanical properties.

The present inventors found that the reason of obtaining the insufficient improvement of the mechanical properties, especially the mechanical strength in the hypereutectic aluminum-silicon alloy produced by the powder metallurgy technique even if the modifier for refining the primary silicon particles in adequate amount is added is to present 0.03% by weight or more of calcium as an impurity therein, said calcium being derived from aluminum and silicon raw materials.

SUMMARY OF THE INVENTION

Accordingly, the present invention provides the hypereutectic aluminum-silicon alloy produced by the powder metallurgy technique comprising 12 to 50% by weight of silicon and 0.01 to 0.05% by weight of phosphorus, the content of calcium as the impurity being controlled to be 0.03% by weight or less.

DETAILED EXPLANATION OF THE INVENTION

The hypereutectic aluminum-silicon alloy of the present invention should contain 12 to 50% by weight of Si. When the Si content is less than 12% by weight, the primary Si particles are not crystallized. On the other hand, when it is above 50% by weight, the amount of the primary Si particles is too much, thereby the machinability and the mechanical strength are poor, even if the primary Si particles are well-reined. The preferable Si content is 20 to 30% by weight.

The hypereutectic aluminum-silicon alloy of the present invention should contain 0.01 to 0.05% by weight of P. P is contained so as to refine the primary Si particles, thereby the hypereutectic aluminum-silicon alloy with uniform dispersion of the well-refined primary Si particles is obtained. When the P content is less than 0.01% by weight, the refinement of the primary $i particles are not well and therefore, the coarse primary $i particles are observed and the improvement of the machinability is not satisfactory. On the other hand, when it is above 0.05% by weight, the primary Si particles cannot be further refined. The preferable P content is 0.015 to 0.05, especially 0.02 to 0.05% by weight.

In the hypereutectic aluminum-silicon alloy of the present invention, the content of Ca as the impurity should be controlled to be 0.03% by weight or less. When the Ca impurity is contained in an amount of above 0.03% by weight in the hypereutectic aluminum-silicon alloy containing the above-defined amounts of Si and P, the improvement of the mechanical properties, especially the mechanical strength is not satisfactory as shown in the examples described hereinafter. Preferably, the Ca content is controlled to be 0.01% by weight or less.

If desired, the hypereutectic aluminum-silicon alloy of the present invention may contain 1.0 to 5.0% by weight of copper 0.5 to 2.0% by weight of magnesium and/or 0.2 to 2.0% by weight of manganese, thereby the mechanical strength can be further improved.

The hypereutectic aluminum-silicon alloy of the present invention is produced by the powder metallurgy technique. In the production of the hypereutectic aluminum-silicon alloy of the present invention, the use of the Al and Si raw materials whose Ca contents are suitably controlled is essential. As the modifier for refining the primary Si particles, the P containing modifier is used, such as Cu-8% by weight of P, Cu-15% by weight of P, $PCl_5$ and a mixture mainly composed of red phosphorus. When the hypereutectic aluminum-silicon alloy of the present invention is produced by, for example, an atomization, it can be obtained in the form of atomized powder. It is desirable to sieve the resultant atomized powder so as to obtain the atomized powder of not more than 350 $\mu$m in particle size which is suitable for practical use. When the hypereutectic aluminum-silicon alloy of the present invention is produced by the method other than the atomization, it can be obtained in the form of flakes or ribbons.

The hypereutectic aluminum-silicon alloy of the present invention is mainly used for the preparation of consolidated products. Generally, the consolidated product are prepared by subjecting to cold shaping followed by subjecting to a hot working such as a hot extrusion or a hot forging, while heating in air or an inert gas such as argon or nitrogen. The thus-prepared consolidated products are applied in various fields. The examples of the consolidated products prepared from the hypereutectic aluminum-silicon alloy of the present invention include automobiles, electrical parts and mechanical parts.

EXAMPLES

The present invention will be better understood by reference to certain experimental examples which are include herein for purposes of illustration only and are not intended to be limiting of the invention.

Examples 1 to 4 and Comparative Examples 1 to 4

Atomized powders were produced by subjecting molten aluminum alloys having compositions shown in Table 1 to an air atomization, and then they were sieved to have the particle size of 100 to 150 mesh (105 to 149 μm) so that a cooling rate is controlled to be constant. The size of the primary Si particles in the atomized powders is determined under an optical microscope.

Further, the atomized powders were sieved to have the particle size of −100 mesh (not more than 149 μm). Then, the sieved atomized powders were cold pressed at 3 tons per $cm^2$ into rods (30 mm in diameter and 80 mm in length) followed by subjecting them to the hot extrusion at the temperature of 480° C. and at the extrusion ratio of 10 into plates (20 mm in width and 4 mm in thickness). After the resultant plates were subjected to T6 treatments, their flexural strengths were determined in accordance with JIS Z2203. The distance between two marks was set to be 30 mm.

The results are shown in Table 1.

TABLE 1

| | composition (wt %) | | | | | | primary Si particles | Flexural strength |
|---|---|---|---|---|---|---|---|---|
| | Si | Cu | Mg | Mn | P | Ca | (μm) | ($kg/mm^2$) |
| Example 1 | 22 | 2.5 | 1.2 | 0.8 | 0.0137 | 0.0019 | 1–4 | 78.3 |
| Example 2 | 23 | 3.0 | 1.2 | 0.5 | 0.0192 | 0.0035 | 1–4 | 77.3 |
| Example 3 | 25 | 3.5 | 0.8 | 1.0 | 0.0284 | 0.0028 | 1–4 | 79.7 |
| Example 4 | 22 | 3.0 | 1.0 | 0.8 | 0.0384 | 0.0045 | 1–4 | 78.4 |
| Comparative Example 1 | 22 | 2.5 | 1.2 | 0.8 | <0.0005 | 0.0030 | 3–20 | 72.1 |
| Comparative Example 2 | 22 | 2.5 | 1.2 | 0.8 | 0.0082 | 0.0032 | 1–15 | 75.1 |
| Comparative Example 3 | 22 | 2.5 | 1.2 | 0.8 | 0.0252 | 0.0387 | 1–4 | 64.7 |
| Comparative Example 4 | 22 | 2.5 | 1.2 | 0.8 | 0.0070 | 0.0320 | 1–15 | 74.1 |

The hypereutectic aluminum-silicon alloys produced in Examples 1 to 4 of the present invention had the well-refined primary Si particles and showed the high flexural strengths.

The hypereutectic aluminum-silicon alloy produced in Comparative Example 1 in which P was not substantially contained had the coarse primary Si particles.

The hypereutectic aluminum-silicon alloy produced in Comparative Example 2 in which the P content was not enough to refine the primary Si particles had the primary Si particles whose refinement was improved as compared with those in Comparative Example 1, but not well.

The hypereutectic aluminum-silicon alloy produced in Comparative Example 3 in which the P content was enough to refine the primary Si particles had the well-refined primary Si particles, but its flexural strength was poor because of its higher Ca content.

The hypereutectic aluminum-silicon alloy produced in Comparative Example 4 in which the P content was not enough to refine the primary Si particles showed the results similar to those in Comparative Example 2.

As clear from the above results, the well-refined primary Si particles are uniformly dispersed in the hypereutectic aluminum-silicon alloy produced by the powder metallurgy technique according to the present invention. Thus, the hypereutectic aluminum-silicon alloy according to the present invention is excellent in machinability. Further, the Ca content in the hypereutectic aluminum-silicon alloy produced by the powder metallurgy technique according to the present invention is controlled, thereby the hypereutectic aluminum-silicon alloy according to the present invention is excellent in the mechanical strength.

What is claimed is

1. A hypereutectic aluminum-silicon alloy produced by a powder metallurgy technique, consisting essentially of 20 to 50% by weight of silicon, 0.01 to 0.05% by weight of phosphorus 1.0 to 5.0% by weight of copper, 0,5 to 2.0% by weight of magnesium and/or 0.2 to 2.0%. by weight of maganese, the content of Ca as an impurity being controlled to be 0.03% by weight or less.

2. The alloy as claimed in claim 1, wherein the Si content is 20 to 30% by weight.

3. The alloy as claimed in claim 1, wherein the P content is 0.015 to 0.05% by weight.

4. The alloy as claimed in claim 1, wherein the Ca content is controlled to be 0.01% by weight or less.

5. The alloy as claimed in claim 1, which is in the form of atomized powder of not more than 350 μm in particle size.

* * * * *